US007590540B2

(12) United States Patent
Zhang et al.

(10) Patent No.: US 7,590,540 B2
(45) Date of Patent: Sep. 15, 2009

(54) METHOD AND SYSTEM FOR STATISTIC-BASED DISTANCE DEFINITION IN TEXT-TO-SPEECH CONVERSION

(75) Inventors: Wei Z W Zhang, Beijing (CN); Xi Jun Ma, Beijing (CN); Ling Jin, Beijing (CN); Hai Xin Chai, Beijing (CN)

(73) Assignee: Nuance Communications, Inc., Burlington, MA (US)

( * ) Notice: Subject to any disclaimer, the term of this patent is extended or adjusted under 35 U.S.C. 154(b) by 721 days.

(21) Appl. No.: 11/239,500

(22) Filed: Sep. 29, 2005

(65) Prior Publication Data

US 2006/0074674 A1 Apr. 6, 2006

(30) Foreign Application Priority Data

Sep. 30, 2004 (CN) ..... 2004 1 0085186

(51) Int. Cl.
*G10L 13/08* (2006.01)

(52) U.S. Cl. ..... 704/260; 704/258; 704/266

(58) Field of Classification Search ..... 704/258, 704/260, 268, 267, 256.6, 266, 257, 243, 704/270, 200
See application file for complete search history.

(56) References Cited

U.S. PATENT DOCUMENTS 5,230,037 A 7/1993 Giustiniani et al. ..... 395/2
5,913,193 A * 6/1999 Huang et al. ..... 704/258
5,913,194 A 6/1999 Karaali et al. ..... 704/259
5,970,453 A 10/1999 Sharman ..... 704/260
5,983,178 A 11/1999 Naito et al. ..... 704/245
6,163,769 A * 12/2000 Acero et al. ..... 704/260
6,185,530 B1 2/2001 Ittycheriah et al. ..... 704/255
6,240,384 B1 5/2001 Kagoshima et al. ..... 704/220
6,317,867 B1 11/2001 Elnozahy ..... 717/1
6,332,121 B1 12/2001 Kagoshima et al. ..... 704/262
6,338,062 B1 1/2002 Liu ..... 707/6
6,507,830 B1 1/2003 Liu ..... 706/48
6,961,704 B1 * 11/2005 Phillips et al. ..... 704/268

FOREIGN PATENT DOCUMENTS

EP 0223014 A1 9/1986
GB 2259599 A 3/1993

OTHER PUBLICATIONS

Kambhatla, N., "Local Models and Gaussian Mixture Models for Statistical Data Processing," PhD. Thesis, Oregon Graduate Institute of Science and Technology, Jan. 1996.

(Continued)

*Primary Examiner*—Huyen X. Vo
(74) *Attorney, Agent, or Firm*—Wolf, Greenfield & Sacks, P.C.

(57) ABSTRACT

A method for distance definition in a text-to-speech conversion system by applying Gaussian Mixture Model (GMM) to a distance definition. According to an embodiment, the text that is to be subjected to text-to-speech conversion is analyzed to obtain a text with descriptive prosody annotation; clustering is performed for samples in the obtained text; and a GMM model is generated for each cluster, to determine the distance between the sample and the corresponding GMM model.

18 Claims, 7 Drawing Sheets

OTHER PUBLICATIONS

Stylianou, Y. and Cappet, O., "A System for Voice Conversion Based on Probabilistic Classification and a Harmonic Plus Noise Model," 1998 IEEE (US6507830).

Yannis Stylianou and Oliver Cappe "A System for Voice Conversion Based on Probabilistic Classification and a Harmonic Plus Noise Model", 1998 IEEE, pp. 281-284.

Nandakishore Kambhatla "Local Models and Gaussian Mixture Models for Statistical Data Processing", Dissertation, R. Tech Institute of Technology, Benasas Hindu University, 1990, pp. i-183.

Xijun Ma et al, "Probability Based Prosody Model for Unit Selection", IEEE May 21, 2004, pp. I649-I652.

* cited by examiner

Figure 2, Log Duration distribution in a leaf of decision tree

Figure 3, Distribution described by GMM

Figure 4 Introduction of decision tree

Figure 5 . Dynamic programming

Figure 6 : Data Dispersive issue in a leaf of pitch tree 7.1 Unreasonable jump without transition constraints 7.2. Simple smoothing removes the reasonable jump Figure 7 Significance of Transition Models

METHOD AND SYSTEM FOR STATISTIC-BASED DISTANCE DEFINITION IN TEXT-TO-SPEECH CONVERSION

FIELD OF THE INVENTION

This invention relates to text-to-speech conversion (TTS). More particularly, this invention relates to a method and system for statistics-based distance definition in text-to-speech conversion.

BACKGROUND OF THE INVENTION

Text-to-speech conversion refers to the technology that intelligently converts words into natural voice flow by using the designs of advanced natural language processing algorithms under the support of computers. TTS facilitates user interaction with the computer, thereby improving the flexibility of the application system.

A typical TTS system as shown in FIG. 1 comprises a text analysis unit 101, a prosody prediction unit 102 and a speech synthesis unit 103. The text analysis unit 101 is responsible for parsing the input plain text into rich text with descriptive prosody annotations such as pronunciations, stresses, phrase boundaries and pauses. The prosody prediction unit 102 is responsible for predicting the phonetic representation of prosody, such as values of pitch, duration and energy of each synthesis segment, according to the result of text analysis. The speech synthesis unit 103 is responsible for generating intelligible voices as a physical result of the representation of semantics and prosody information implicitly contained in the plain text.

For example, performing TTS on the text "这是一个专利申请"will result in the following. First the text is input into the text analysis unit 101, so that the pronunciation of each character and the phrase boundaries are identified as follows. The following example uses Chinese language text, but of course the present invention may be applied to any language.

这 | 是 | 一 个 | 专 利 申 请.

zhe4 shi4 yi2 ge4 zhuan1 li4 shen1 qing3

With the above text analysis, the prosody prediction unit 102 performs prosody prediction on the characters in the text. Then, the speech synthesis unit 103 will produce the voice corresponding to said text based on the predicted prosody information. In current TTS technologies, statistics-based distance definition approaches are an important tendency. In these kinds of approaches, text analysis and prosody prediction models are trained from a large labeled corpus, and speech synthesis is always based on selection of multiple candidates for each synthesis segment. A general framework for the TTS-based corpus is shown in FIG. 2.

In statistics based approaches, especially in prosody prediction and inventory based selection, many difficult problems involve the distance definition between a sample and a given cluster. Even with complex contexts to cluster data, the problem of data dispersing is so serious in almost every cluster, and the overlap among clusters is so serious, that it is difficult to evaluate whether the sample belongs to the given cluster.

There are some classical definitions used in current TTS, such as the weighted Euclid distance and the Mahalanobis distance. For the Euclid distance, by using an average of the used sample points as the sample point, it is often difficult to choose the most appropriate value to be the sample point. Moreover, the relationship among different dimensions may be ignored or poorly modeled by pre-given knowledge. A problem with the Mahalanobis distance is the poor capability to simulate the complex distribution.

FIG. 3 is a histogram, with the duration distribution of a sample in a cluster in a TTS corpus being a log distribution. As shown in FIG. 3, the data is so dispersive that the mean value approach of the Euclid distance is not able to simulate its distribution, and Mahalanobis distance seems difficult for a refined simulation also because it is not a normal distribution.

SUMMARY OF THE INVENTION

In consideration of the above problems, the present invention is proposed, where the Gaussian Mixture Model (GMM) is applied to distance definition in TTS. More particularly, the invention relates to a novel statistics-based distance definition approach used for text-to-speech conversion. In the distance definition according to the present invention, probability distribution is prominently adopted through the GMM. The present invention may be used to better solve such difficulties as data sparseness and data dispersing in TTS statistical technology by using of the probability distribution, as compared with the afore-mentioned Euclid distance and Mahalanobis distance. GMM is an algorithm to describe some complex distribution by a cluster of Gaussian models with simple parameters for each Gaussian model. For example, the distribution of FIG. 3 can be simulated by a GMM combined with two Gaussian models. FIG. 4 is the illustration of the simulation. Although for illustrative a distribution is shown in FIG. 3 using two Gaussian distributions, it will be understood by those skilled in the art that it is possible to use more than two distributions as required.

According to embodiments of the invention, there is provided a method for distance definition in the TTS system, comprising the steps of: analyzing the text that is to be subjected to TTS, to obtain a text with descriptive prosody annotation; performing clustering for the samples in the obtained text; and generating a GMM model for each cluster, to determine the distance between the sample and the corresponding GMM model. According to embodiments of the invention, there is provided a system for distance definition in the TTS system, comprising: a text analysis unit, for analyzing the text that is to be subjected to TTS, to obtain a text with descriptive prosody annotation; a prosody prediction unit, for performing clustering for the samples in the text obtained by the text analysis unit; and a GMM model base, connected to said prosody prediction unit, for storing the generated GMM models. These first and second aspects of the invention are directed to training the GMM models by using the corpus.

According to embodiments of the invention, there is provided a method for speech synthesizing in the TTS system, comprising the steps of: determining the cluster for the unit to be subjected to TTS, thereby to determine the GMM model of said cluster; calculating the distance between the candidate samples in the cluster and the determined GMM model; and identifying the sample with the smallest distance for subsequent speech synthesizing. According to embodiments of the invention, there is provided a system for speech synthesizing in the TTS system, comprising: a cluster determining unit, for determining the cluster for the unit to be subjected to TTS, thereby to determine the GMM model of said cluster; a distance calculating unit, for calculating the distance between the candidate samples in the cluster and the determined GMM model; and an optimizing unit, for identifying the sample with the smallest distance for subsequent speech synthesizing. These third and forth aspects of the invention are directed to speech synthesis by using GMM models.

DETAILED DESCRIPTION

Embodiments of the invention will be described in connection with the drawings. However, it should be readily understood that these embodiments are illustrative only and should not be taken as limiting the scope of the invention.

A GMM portrays the distribution of the samples in the current cluster. For a position where the distribution is dense, the output probability is large, and for a position where the distribution is sparse, the output probability is small. The distance between a unit and a GMM model describes the degree of approximation between the unit and the cluster where the model is located. With GMM being an abstract representation of said cluster, the distance between a unit and the GMM model can be depicted by using the probability output of the unit in that model, the larger the probability, the smaller the distance, and vice versa.

Assuming that G represents the GMM model, the probability output of unit X in G is P(X|G), and the distance definition between X and G is D(X, G). Where there are two units X1 and X2, if P(X1|G)>P(X2|G), then D(X1, G)<D(X2, G); if P(X1|G)<P(X2|G), then D(X1, G)>D(X2, G); and if P(X1|G)=P(X2|G), then D(X1, G)=D(X2, G).

Figure 5:
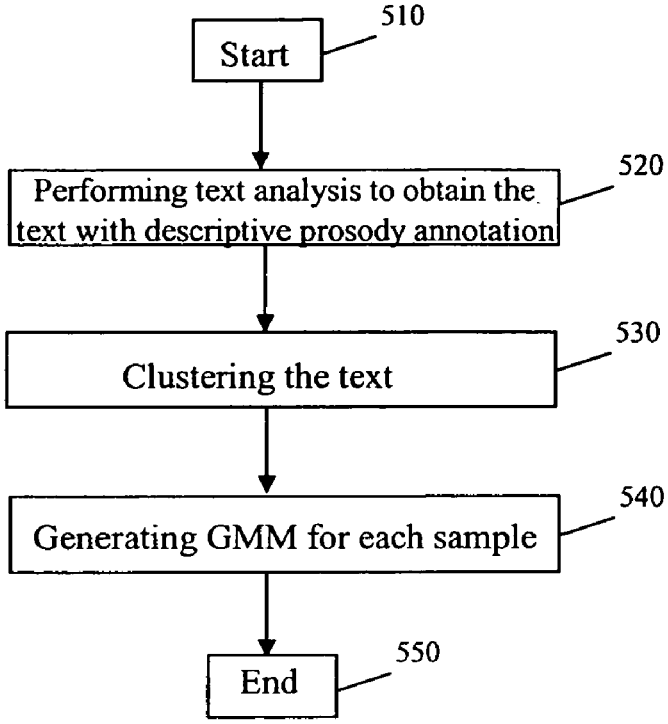
FIG. 5 is a flowchart for the training process of the method according to embodiments of the present invention.

Now, reference is made to FIG. 5, where the flowchart for the training stage for the method according to embodiments of the invention is shown. The method starts from step S510, and then proceeds to step S520. Step S520 is to analyze the text to be TTS converted, so as to attain text with descriptive prosody annotation. Then, the method proceeds to step S530, where the samples in the text is clustered. As is known by a skilled person, the "sample" can mean the condition on which the modeling is based, for example, if the duration is to be modeled, then the duration itself is a sample. After the samples are clustered, the method proceeds to step S540, where a GMM model is generated for each cluster. With the generation of the GMM model, the method ends with steps S550. The generated GMM model will be used in the subsequent speech synthesis process, as is described later.

Next, the specific way for clustering the samples will be elaborated. As is known by those skilled in the art, the samples can be clustered in numerous ways. For example, the samples can be clustered by dimensions, or by such conditions as "duration". However, according to embodiments of the invention, the samples are clustered by using the decision tree. The decision tree is a data-driven auto-clustering method, wherein the clustering is decided through data, whereby it is unnecessary for the user to be knowledgeable about clustering. In TTS, decision tree is popularly used for context dependent clustering or prediction. There can be various types of decision trees, and FIG. 6 shows the main idea of a decision tree.

All of the data in the parent node of the tree is split into two child nodes by an optimized question from a pre-defined question set. Following a pre-defined criteria, the distance in any child node is small and between two child nodes is large. After each split process, an optional function can be done to merge the similar nodes among all of the leaves. All of the splitting, stop-splitting and merging are optimized by the pre-defined criteria.

Figure 1:
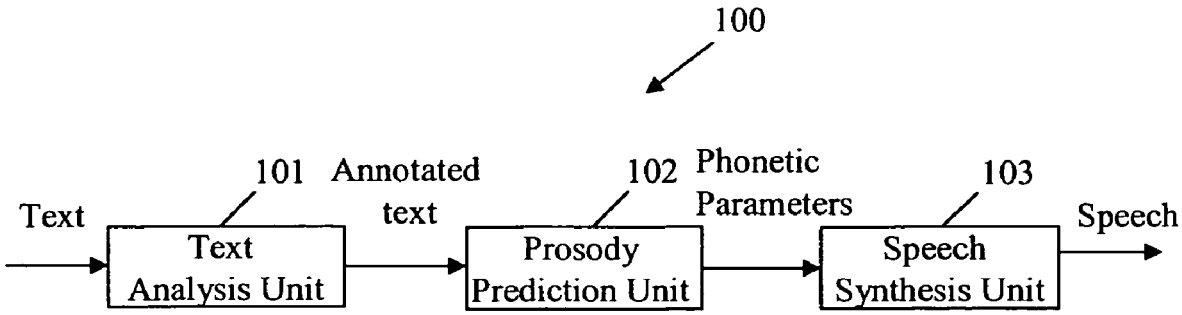
FIG. 1 is a block diagram of a typical TTS system.
Figure 2:
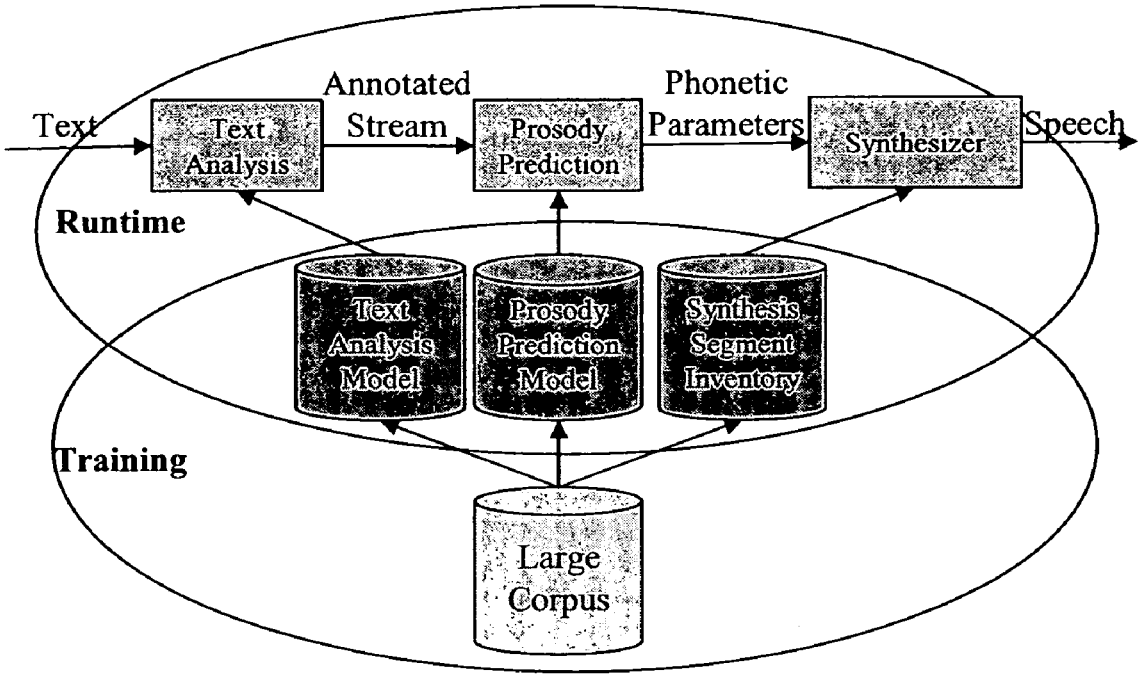
FIG. 2 is a block diagram of a general corpus-based TTS.
Figure 3:
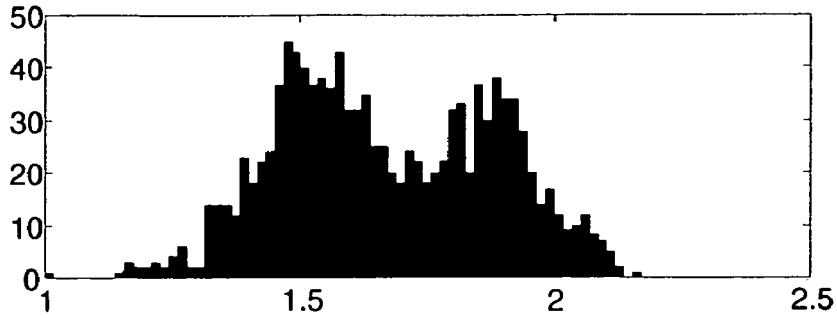
FIG. 3 shows a log duration distribution of a sample in a cluster of a TTS corpus.
Figure 4:
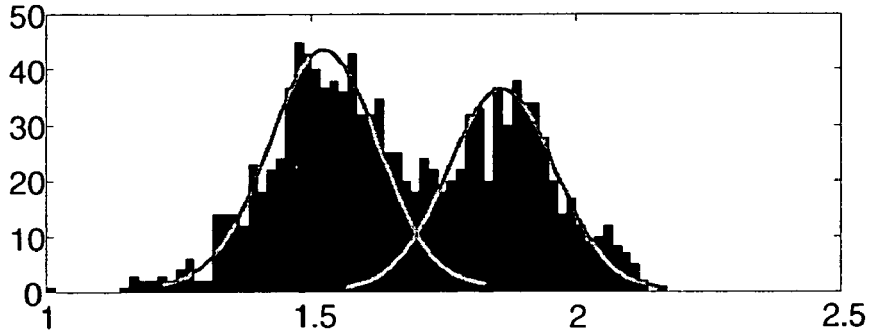
FIG. 4 is a diagram showing the simulation of the distribution of FIG. 3 by using GGM combined with two Gaussian models.
Figure 6:
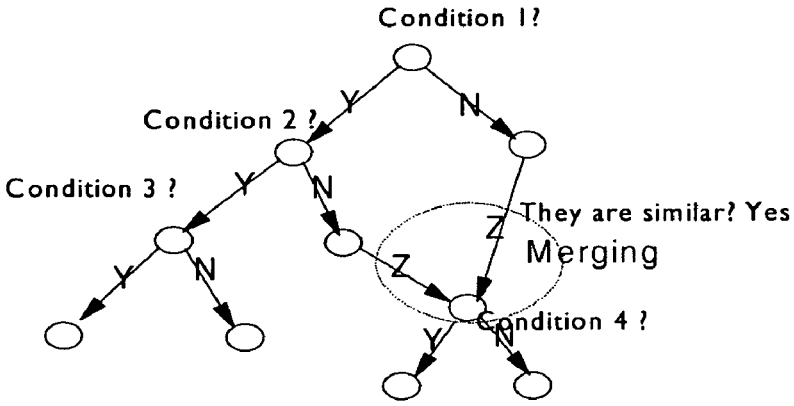
FIG. 6 is a diagram of the decision tree used for clustering the samples.

Reference is now made to FIG. 6, assuming that condition 1 is if at the beginning of the sentence, condition 2 is if at the forth tone, and condition 3 is if a light tone is followed. If a sample traverses enough nodes in the decision tree (here, 3 nodes are shown for the purpose of illustration) for achieving a suitable cluster, a GMM model is generated for that cluster. Since various ways for generating GMM models for the cluster are known in the related art, no detailed description will be provided herein.

Further, if two clusters are close enough in the decision tree, the two clusters can be combined for subsequent clustering. As is shown in FIG. 6, the "No" branches of conditions 1 and 2 are close to each other (or, they are similar), therefore they are combined and thereafter used for further clustering at condition 4. As is readily recognizable, the distance definition system may comprise a combining unit for implementing the above branch combining operations in the decision tree.

For more information about GMM models, please refer to N. Kambhatla, "Local Models and Gaussian Mixture Models for Statistical Data Processing" PhD thesis, Oregon Graduate Institute of Science and Technology, January, 1996.

Figure 7:
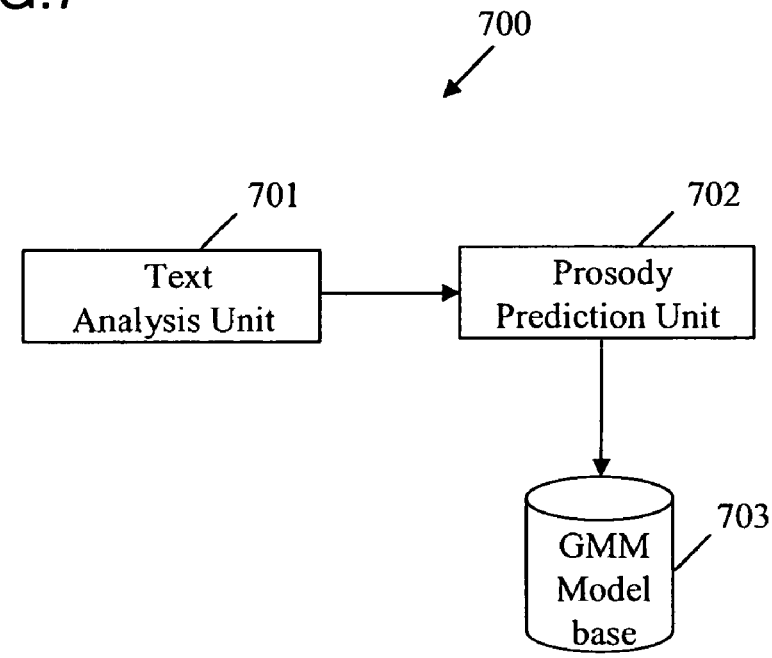
FIG. 7 is a block diagram for the training section of the system according to embodiments of the present invention.

FIG. 7 depicts the training system according to embodiments of the present invention. As is shown in FIG. 7, the training system 700 comprises a text analysis unit 701, a prosody prediction unit 702, and a GMM model storing unit 703 connected to said prosody prediction unit 702, used for storing the GMM models generated for each cluster.

According to embodiments of the invention, said training system 700 may also contain means for storing a series of optimization questions (not shown), means for decision making with respect to said optimization questions (not shown) and means for combining the appropriate clusters for implementing the above-mentioned decision tree.

Figure 8:
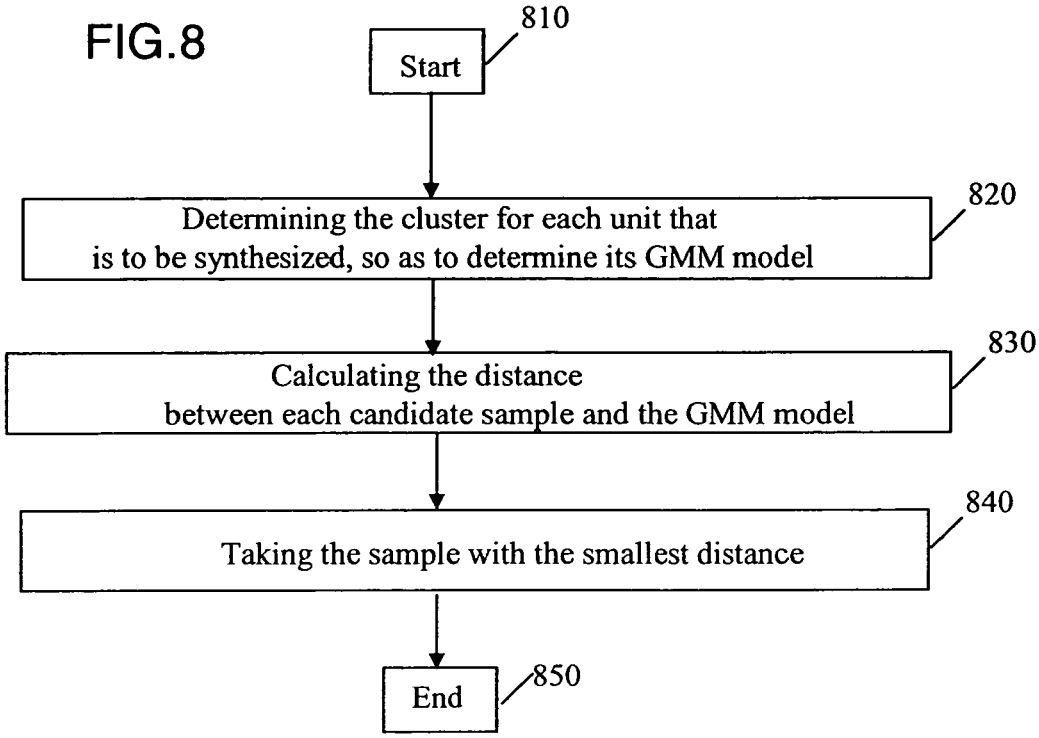
FIG. 8 is a flowchart for the synthesizing process of the method according to embodiments of the present invention.

The method and system on the synthesis section according to embodiments of the invention will now be described with reference to FIG. 8, a flowchart of a synthesizing method. The synthesizing method starts from step S810 and then proceeds to step S820. In step S820, the cluster of the unit that is to be synthesized (for example, it can be a character contained in the text) is determined so as to determine the GMM model thereof. The cluster can be determined, for example, through a series of questions in the decision tree, so as to find the GMM model corresponding therewith from the GMM model base. Next, in step S830, the distance between the candidate samples in the cluster and the found GMM model is calculated. One possible method of calculation is detailed below.

After calculating the distance, the sample with the smallest distance is identified as the optimal sample in step S840 for synthesizing. Then, the method ends in step S850.

Step S830 will be elaborated in detail now. As mentioned above, embodiments of the method of the invention involves the calculation of the distance between each unit that is to be synthesized and the GMM model thereof, and the sample with the smallest distance is the best. Said distance is also known as the target cost. After calculation is completed for each unit to be synthesized, the final synthesized speech is obtained by adding all the resulting units that have the smallest distance. According to embodiments of the present invention, said cost can be calculated by employing dynamic programming. That is, to find the global optimized path through local optimized cost function estimation.

According to embodiments of the invention, a transition cost can be calculated in addition to said target cost. Target cost means the distance between a unit that is to be synthesized and the GMM model thereof. The speech parameters of two consecutive synthesizing units need to satisfy certain transition relationship. Only matched unit can achieve a high degree of naturalness, and a transition model depicts this transition relationship from a modeling perspective.

An evaluation of the transition features of the speech parameters of two consecutive synthesizing units in the current transition model, that is, the distance between the transition feature and the current transition model, is known as the transition cost. This distance can also be interpreted as a GMM model distance.

Figure 9:
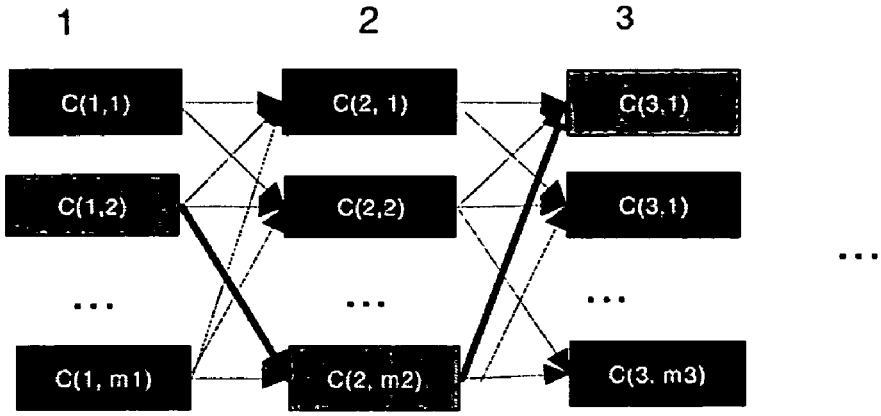
FIG. 9 is a diagram for dynamic planning according to embodiments of the invention.

As shown in FIG. 9 with the solid lines, the cost of each possible path can be attained by the accumulation of the target cost of each node and the transition cost between two neighboring nodes in the path. After all of the possible paths are evaluated, the global optimized path is generated with the smallest cost.

As shown in FIG. 9, assuming that C(1, x) represents the character in the previous text, C(2,x) ""是"" and C(3, x)"—" and so on. According to an embodiment of the invention, the voice output can be obtained by choosing only the smallest target cost of each unit to be synthesized and directly adding the units with the smallest target costs together. However, according to another embodiment of the invention, the transition cost may be taken into account as well. In FIG. 9, the path C(1, 2)-C(2, m2)-C(3, 1) is considered the path with the smallest target cost plus transition cost.

Figure 10:
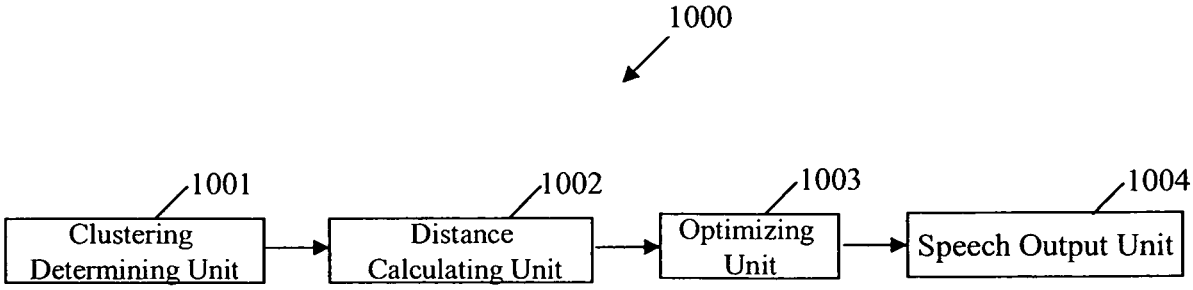
FIG. 10 is a block diagram for the synthesizing section of the system according to embodiments of the present invention.

The synthesizing process of the invention may be implemented through the synthesizing system 1000 shown in FIG. 10. The synthesizing system 1000 comprises a cluster determining unit 1001 used for determining the cluster of the unit that is to be synthesized so as to determine the corresponding GMM model from the GMM model base. After the determination of the GMM model, a distance calculating unit 1002 is used to calculate the distance between the candidate samples in the cluster and the found GMM model. Then, an optimizing unit 1003 is to evaluate the resulting distances so as to find the unit with the smallest distance. Said unit with a smallest distance is output to a synthesizing unit 1004 to form the physical voice.

In addition, said distance calculating unit 1002 may also comprise a target cost calculating unit and a transition cost calculating unit which are not shown.

The distance definition based on GMM is illustrated above. There are two typical scenarios to use the definition. One is to evaluate the distance between a given sample and a given cluster, which is the task of unit-selection based approach, and the other is to predict the explicit phonetic parameters through searching in the space of the given probability distributions.

The steps to apply the definition for unit selection in a TTS system are listed as follow:

(In the Training Process)

1. Extracting phonetic parameters and its context information from the labeled corpus;
2. Context equivalent clustering of phonetic parameters and the distance among phonetic parameters are given by GMM based distance definition;
3. Generating GMM to describe the probability distribution of each cluster generated in step 2.

(In the Synthesis Process)

4. Getting context information of each phonetic segment (that is, the unit to be synthesized) from the result of the text analysis unit;
5. Finding the context equivalent cluster of each segment, which is corresponding to a GMM;
6. Evaluating all of the candidates of the segment by GMM based distance definition;
7. Finding overall optimized candidate sequence based on distances given in step 6 and criteria of overall optimization such as dynamic programming;
8. Speech synthesis to generate physical voice.

The steps to apply the definition for explicit prediction are listed as follow:

(In the Training Process)

1. Extracting phonetic parameters and its context information from the labeled corpus;
2. Context equivalent clustering of phonetic parameters and the distance among phonetic parameters are given by GMM based distance definition;
3. Generating GMM to describe the probability distribution of each cluster generated in step 2;

(In the Synthesis Process)

4. Getting context information of each phonetic segment (that is, the unit to be synthesized) from the result of text analysis component;
5. Finding the context equivalent cluster of each segment, which is corresponding to a GMM;
6. In the space of the mixture model sequence, searching the best values based on the distance definition and criteria of overall optimization, and the sequence of best values is regarded as the explicit prediction;
7. Synthesis according to the explicit prediction given in step 6.

In order to implement the above operations, said cluster determining unit 1001 can further comprise a prosody annotation information acquiring means for acquiring the descriptive prosody annotation information of the unit to be synthesized; finding means for finding the cluster of each unit to be synthesized, said cluster corresponding to a GMM model; and means for searching for the optimal value based on the distance definition and the overall optimal criteria in the space of the GMM mixture model series so that the optimal series is used as the explicit prediction of the GMM model.

Correspondingly, the distance calculating unit 1002 can further comprise a prosody annotation information acquiring means for acquiring the descriptive prosody annotation information of the unit to be synthesized; finding means for finding the cluster of each unit to be synthesized, said cluster corresponding to a GMM model; and candidate evaluating means for evaluating all the candidates of the unit to be synthesized through the GMM-based distance definition. Meanwhile, the optimizing unit 1003 can further comprise a means for acquiring the overall optimal candidate series based on the distance given in the evaluation steps and the overall optimal criteria for subsequent voice synthesizing.

Figure 11:
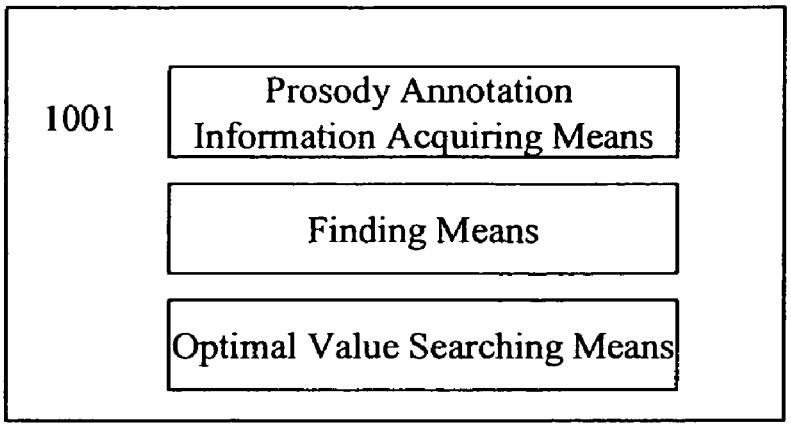
FIGS. 11 and 12 are block diagrams for the cluster determining unit, distance calculating unit and the optimizing unit.
Figure 12:
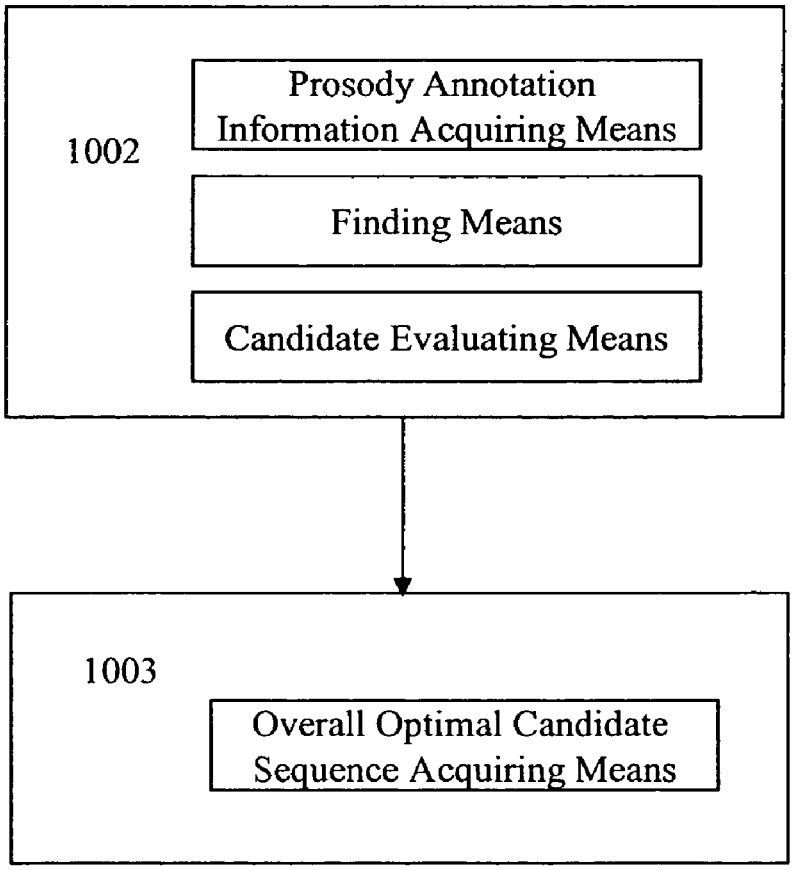

FIGS. 11 and 12 present illustrative configurations of the cluster determining unit 1001, the distance calculating unit 1002, and the optimizing unit 1003. It should be noted that, the various means can have different ways for implementation, for example, by using the computer program code unit or electronic logic circuit, which is within the comprehension of those skilled in the art, and therefore detailed explanation will be omitted.

The essential of GMM based distance definition is to precisely simulate the probability distribution of a defined cluster in data for TTS, and then give the distance between an isolated sample and the cluster, which is very critical for unit selection based approach. Another advantage of GMM based distance definition is that some mature algorithms of tolerance, adaptation and so on can be smoothly deployed in statistical technologies of TTS.

In the TTS training and synthesizing according to embodiments of the invention, a decision tree, GMM, and dynamic programming may be combined to form a unit selection based TTS system, wherein GMM is used to describe the prediction of the target for each node in the synthesis sequence and the prediction of transition between the neighboring nodes.

The main points in the combination lie in:

At first, a decision tree based clustering algorithm is used to split all of the prosody vectors of segments in corpus into reasonable classes. The number of classes depends on the pre-defined criteria and the amount of data in corpus.

For each class, a GMM is trained based on the data in it.

The cost functions in dynamic programming are changed to be log probability function, which means that the global optimized path is the one with largest accumulation log probability values. It may be regarded as the negative operation of cost functions.

GMMs of prosody targets for each node generate target log probability functions. Target prediction is a popular approach in some TTS systems, and GMMs of prosody transitions for two neighboring nodes may generate transition log probability functions.

Figure 13:
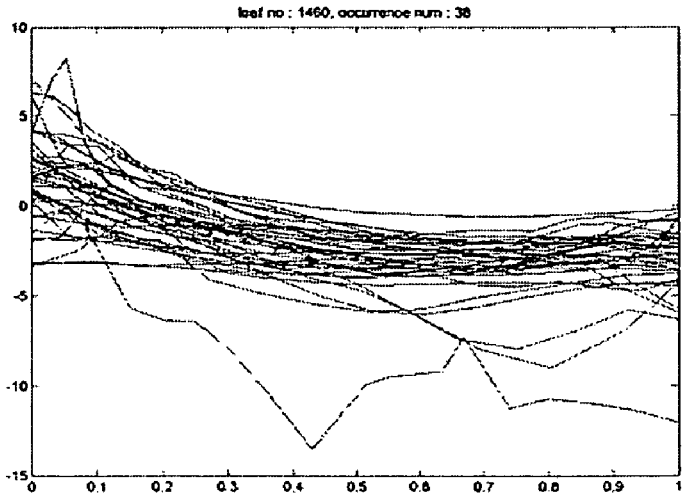
FIG. 13 shows all the data in a leaf in the pitch tree.

The concept of prosody transitions is introduced below. As mentioned before, target prosody is broadly used, which is a natural way to predict the expectation of each segment and do selection based on the prediction. The biggest challenge may be the data dispersing problem. For example, FIG. 13 is a graph of all the data in a leaf of a pitch tree. The range appears large and the distribution appears average. Although it is easy to give out target probability prediction through GMM model for targets, it is difficult to expect that only target models can get good selection result.

Figure 14:
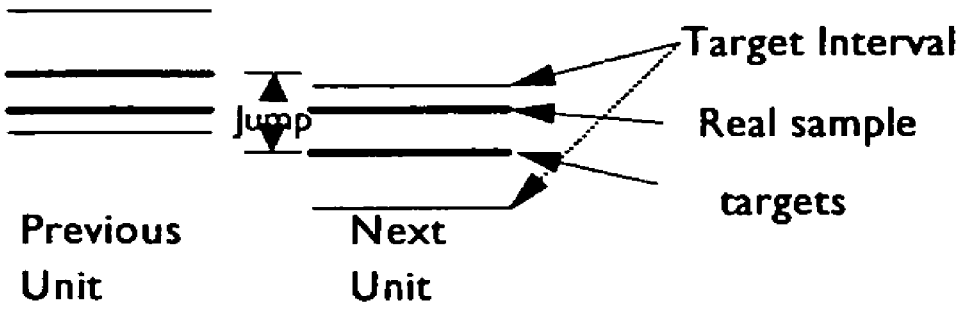
FIG. 14 shows a situation where there are unreasonable jumps between neighboring units.
Figure 14:
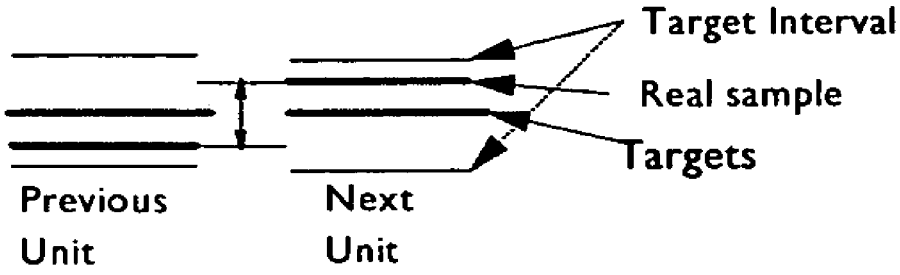

Smoothing criteria may be used to resolve some problems, but not all, and the most important issue is that some cases become bad with simple smoothing criteria. FIG. 14 elaborates the phenomena more in detail. The two parameters between neighboring units may exist at a reasonable jump, and the amplitude values of jumps are context dependent.

Probability model for transition prosody is proposed to model the variety between the two neighboring segments. There are many transition related prosody parameters, for example, difference of log pitch, log duration and loudness values between the two segments. It is natural that the transition models generate the transition probability output in the dynamic programming searching scheme.

According to embodiments, the probability model of transition prosody integrated into the combination of decision tree, GMM, and dynamic programming. On the one hand, all of the segments in corpus can be used to train a target probability prediction tree and a single transition probability trees, which means that there are no data sparse problems in probability model building. Because of transition model, even though there are still data dispersing problems, the influence is partly removed, which makes the predicted prosody more stable and more reasonable.

The foregoing description of the exemplary embodiment of the invention has been presented for the purposes of illustration and description. It is not intended to be exhaustive or to limit the invention to the precise form disclosed. May modifications and various are possible in light of the above teachings. For example, this invention can be implemented by means of software, hardware or the combination thereof. It is intended that the scope of the invention be limited not with this detailed description, but rather determined by the appended claims.

The invention claimed is:

1. A method comprising the steps of:

analyzing text that is to be subjected to text-to-speech conversion to obtain text with descriptive prosody annotation;

performing clustering for samples in the obtained text through the use of a decision tree, wherein clustering comprises combining two branches of the decision tree for clustering samples if the two branches are similar for further clustering;

generating a Gaussian Mixture Model for each cluster to determine the distance between the sample and the corresponding Gaussian Mixture Model;

using electronic logic circuitry to identify a sample according to the distance; and transforming the identified sample into synthesized speech.

2. A system comprising:

a text analysis unit for analyzing text that is to be subjected to text-to-speech conversion to obtain text with descriptive prosody annotation;

a prosody prediction unit for performing clustering for samples in the text obtained by the text analysis unit through the use of a decision tree, wherein the prosody prediction unit comprises a combining unit for combining similar branches in the decision tree for further clustering;

a Gaussian Mixture Model base, coupled to the prosody prediction unit, for storing a generated Gaussian Mixture Model; and a distance calculating unit using electronic logic circuitry for calculating the distance between candidate samples in a cluster and a Gaussian Mixture Model; and an optimizing unit, for identifying the candidate sample with the smallest distance for subsequent speech synthesizing.

3. A method comprising the steps of:

determining a cluster for a unit to be subjected to text-to-speech conversion;

determining the Gaussian Mixture Model for the cluster, wherein the Gaussian Mixture Model is generated for a sample clustered through the use of a decision tree which includes combining two branches in the decision tree for clustering samples if the two branches are similar for further clustering;

calculating the distance between candidate samples in the cluster and the determined Gaussian Mixture Model;

using electronic logic circuitry to identify the sample with the smallest distance for subsequent speech synthesizing; and transforming the identified sample into synthesized speech.

4. The method according to claim 3, wherein the step of identifying the sample with the smallest distance comprises identifying the sample with the smallest target cost plus transition cost.

5. The method according to claim 3, wherein the step of identifying the sample with the smallest distance comprises identifying the sample with the smallest target cost.

6. The method according to claim 3, wherein the calculating step comprises calculating the target cost and the transition cost.

7. The method according to claim 6, wherein the step of identifying the sample with the smallest distance comprises identifying the sample with the smallest target cost.

8. The method according to claim 6, wherein the step of identifying the sample with the smallest distance comprises identifying the sample with the smallest target cost plus transition cost.

9. The method according to claim 3, wherein the step of determining the cluster for the unit to be subjected to text-to-speech conversion comprises:

obtaining descriptive prosody annotation information of each unit to be subjected to text-to-speech conversion;

finding the context equivalent cluster of each unit to be subjected to text-to-speech conversion, the cluster coffesponding to a Gaussian Mixture Model; and in the space of the Gaussian Mixture Model mixture model sequence, searching for the best values based on the distance definition and criteria of overall optimization.

10. The method according to claim 3, wherein the steps of calculating the distance between the candidate samples in the cluster and the determined Gaussian Mixture Model and identifying the sample with the smallest distance for subsequent speech synthesizing comprises:

obtaining descriptive prosody annotation information of each unit to be subjected to text-to-speech conversion;

finding the context equivalent cluster of each unit to be subjected to text-to-speech conversion, the cluster coffesponding to a Gaussian Mixture Model;

evaluating all the candidates of the unit to be text-to-speech conversion synthesized through the Gaussian Mixture Model-based distance definition; and finding the overall optimal candidate series, for subsequent speech synthesizing, based on the distance given in the evaluating step and criteria of overall optimization.

11. A system comprising:

a cluster determining unit for determining the cluster for the unit to be subjected to text-to-speech conversion to determine the Gaussian Mixture Model of the cluster, wherein the Gaussian Mixture Model is generated from samples clustered through the use of a decision tree which includes combining two branches in the decision tree for clustering samples if the two branches are similar for further clustering;

a distance calculating unit; using electronic logic circuitry for calculating the distance between the candidate samples in the cluster and the determined Gaussian Mixture Model; and an optimizing unit, for identifying the sample with the smallest distance for subsequent speech synthesizing.

12. The system according to claim 11, wherein the optimizing unit is configured to identify the sample with the smallest target cost plus transition cost.

13. The system according to claim 11, wherein the optimizing unit is configured to identify the sample with the smallest target cost.

14. The system according to claim 11, wherein the distance calculating unit further comprises a unit for calculating a target cost and a unit for calculating a transition cost.

15. The system according to claim 14, wherein the optimizing unit is configured to identify the sample with the smallest target cost plus transition cost.

16. The system according to claim 14, wherein the optimizing unit is configured to identify the sample with the smallest target cost.

17. The system according to claim 11, wherein the cluster determining unit further comprises:

means for getting descriptive prosody annotation information of each unit to be subjected to text-to-speech conversion;

means for finding the context equivalent cluster of each unit to be subjected to text-to-speech conversion, the cluster coffesponding to a Gaussian Mixture Model; and means for, in the space of the mixture model sequence, searching for the best values, to be used as the as the explicit prediction, based on the distance definition and criteria of overall optimization.

18. The system according to claim 11, wherein the calculating unit further comprises:

means for obtaining descriptive prosody annotation information of each unit to be subjected to text-to-speech conversion;

means for finding the context equivalent cluster of each unit to be subjected to text-to-speech conversion, which corresponds to a mixture model;

means for evaluating all the candidates of the unit to be text-to-speech conversion synthesized through the Gaussian Mixture Model-based distance definition; and wherein the optimizing unit further comprises means for finding the overall optimal candidate series, for subsequent speech synthesizing, based on the distance from the means for evaluating and criteria of overall optimization.

* * * * *